US008297619B2

(12) United States Patent
Bateng Tchounkwa

(10) Patent No.: US 8,297,619 B2
(45) Date of Patent: Oct. 30, 2012

(54) WORD FORMING GAME KIT

(76) Inventor: Bertin Bateng Tchounkwa, Laval (CA)

( * ) Notice: Subject to any disclaimer, the term of this patent is extended or adjusted under 35 U.S.C. 154(b) by 123 days.

(21) Appl. No.: 12/817,743

(22) Filed: Jun. 17, 2010

(65) Prior Publication Data

US 2010/0320688 A1 Dec. 23, 2010

(51) Int. Cl.
*A63F 3/00* (2006.01)

(52) U.S. Cl. ..... 273/272; 273/299; 434/172

(58) Field of Classification Search ..... 273/272, 273/296, 299, 148 R, 148 A, 150, 146; 434/171, 434/172
See application file for complete search history.

(56) References Cited

U.S. PATENT DOCUMENTS

| | | | | | |
|---|---|---|---|---|---|
| 942,667 | A | * | 12/1909 | Smith | 273/150 |
| 977,117 | A | | 11/1910 | Perrott et al. | |
| 1,332,249 | A | | 3/1920 | Scott | |
| 1,684,813 | A | * | 9/1928 | Ward | 273/148 A |
| 3,116,927 | A | * | 1/1964 | Kuhlman | 273/272 |
| 4,014,548 | A | | 3/1977 | Trilling | |
| 4,185,830 | A | | 1/1980 | James | |
| 4,227,698 | A | * | 10/1980 | Ishizuki | 273/309 |
| 4,416,455 | A | * | 11/1983 | Munson et al. | 273/272 |
| 4,461,483 | A | * | 7/1984 | Kopp | 273/265 |
| 4,469,329 | A | * | 9/1984 | Guyer | 273/146 |
| 4,678,190 | A | | 7/1987 | Dery | |
| 4,684,132 | A | * | 8/1987 | Wolford | 273/150 |
| D291,900 | S | * | 9/1987 | Mortensen | D21/392 |
| 4,896,889 | A | * | 1/1990 | Kuhn et al. | 273/272 |
| 4,962,930 | A | * | 10/1990 | Griffith | 273/146 |
| 5,029,797 | A | * | 7/1991 | Levorchick et al. | 248/459 |
| 5,082,288 | A | * | 1/1992 | Swartz | 273/244 |
| 5,366,227 | A | * | 11/1994 | Duffy | 273/287 |
| 5,558,328 | A | * | 9/1996 | Krantz | 273/146 |
| 5,558,330 | A | * | 9/1996 | McCune | 273/150 |
| 5,590,880 | A | * | 1/1997 | Flam | 273/150 |
| 5,615,886 | A | | 4/1997 | Chalfin et al. | |
| 5,769,421 | A | | 6/1998 | Wakefield | |
| 6,053,741 | A | * | 4/2000 | Wood | 434/348 |
| 6,241,246 | B1 | * | 6/2001 | Guttin et al. | 273/139 |
| 6,623,009 | B1 | | 9/2003 | Kraemer et al. | |
| 6,926,275 | B1 | | 8/2005 | Zocchi | |
| 7,044,467 | B1 | | 5/2006 | Dimmig | |
| 7,216,868 | B2 | | 5/2007 | Groz et al. | |
| 7,243,920 | B2 | * | 7/2007 | Braun | 273/309 |
| 7,275,746 | B2 | * | 10/2007 | Jensen | 273/272 |
| 7,568,698 | B2 | * | 8/2009 | Bertrand | 273/150 |
| 7,661,676 | B2 | * | 2/2010 | Smith et al. | 273/149 R |
| 2003/0052448 | A1 | * | 3/2003 | Bertrand | 273/148 R |
| 2003/0201601 | A1 | * | 10/2003 | Koopman | 273/146 |

(Continued)

OTHER PUBLICATIONS

Kingfisher, J.S./Philomuse, The Musician's Dice, http://philomuse.com/products/musiciansdice/dice, 2008.

(Continued)

*Primary Examiner* — William Pierce
(74) *Attorney, Agent, or Firm* — Bereskin & Parr LLP/S.E.N.C.R.L., s.r l

(57) ABSTRACT

There is provided a game kit comprising (i) a plurality of game pieces, the pieces comprising at least two faces and the faces comprising at least one symbol thereon; and (ii) a holder comprising at least one holding section for holding the game pieces in such a manner that when at least one of the game pieces is inserted in the holding section, the holding section is effective for hiding at least one symbol of the at least one of the game pieces.

13 Claims, 2 Drawing Sheets

U.S. PATENT DOCUMENTS

| | | | | |
|---|---|---|---|---|
| 2005/0236768 | A1* | 10/2005 | Watson | 273/146 |
| 2006/0022407 | A1* | 2/2006 | Jensen | 273/272 |
| 2007/0102878 | A1* | 5/2007 | Quach | 273/149 R |
| 2007/0235931 | A1* | 10/2007 | Simmons, II | 273/256 |
| 2007/0257434 | A1* | 11/2007 | Lingenfelser | 273/272 |

OTHER PUBLICATIONS

Parent Child Education, Domino, http://parentchildeducation.com/units/abc/epidode0021abc.php, 2010.

* cited by examiner

WORD FORMING GAME KIT

FIELD OF THE DISCLOSURE

The present disclosure relates to the field of games such as board games, games involving several pieces, or games used for practicing written language.

BACKGROUND OF THE DISCLOSURE

Many existing word-forming games use game pieces or letter tiles with one letter imprinted on them. Players randomly select letters from a pool of letters and place them on a board to create words. The players play against one another and they have to pick up lots of letters to be able to create words. They also need a board to align the letters of each word they created with their letters.

Other games are based on the use of pre-made words to create sentences, expressions or small texts. This sort of game does not allow players to practice writing new words or expressions since they are already provided for them.

SUMMARY OF THE DISCLOSURE

According to one aspect, there is provided a game kit comprising:

a plurality of game pieces, the pieces comprising at least two faces and the faces comprising at least one symbol thereon; and a holder comprising at least one holding section for holding the game pieces in such a manner that when at least one of the game pieces is inserted in the holding section, a combination of the game pieces and the holding section is effective for hiding all the symbols of the game pieces except one selected symbol for each game piece, optionally with the exception of game pieces disposed at extremities of the holding section.

According to another aspect, there is provided a game kit comprising:

a plurality of game pieces, the pieces comprising at least two faces and the faces comprising at least one symbol thereon; and a holder comprising at least one holding section for holding the game pieces in such a manner that when at least one of the game pieces is inserted in the holding section, the holding section is effective for hiding at least one symbol of the at least one of the game pieces.

BRIEF DESCRIPTION OF THE DRAWINGS

In the appended drawings which represent various examples of the present disclosure.

DETAILED DESCRIPTION OF THE DISCLOSURE

This section describes examples of the present disclosure.

For example, the game kit can be used to stimulate players to learn and master written language. This game kit can allow players to practice any type of written language.

Game Pieces

For example, in the kit of the present disclosure, the game pieces can be pawns, dices or counters.

Figure 1A:
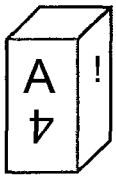
FIGS. 1A and 1B each represents is a perspective view of a game piece of a rectangular parallelepiped shape with four rectangular faces bearing two symbols on each face according to an example of the present disclosure.
Figure 1B:
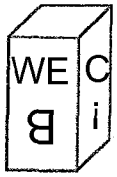
Figure 2:
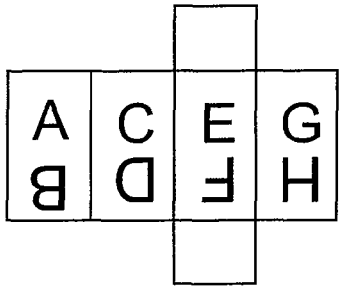
FIG. 2 is a schematic representation illustrating six faces of a game piece similar to the game pieces of FIGS. 1A and 1B in an open or unfolded configuration which displays eight symbols according to another example of the present disclosure.

According to one embodiment, the game pieces are of a rectangular parallelepiped shape having four faces with two symbols on each face of the rectangular parallelepiped shape. The two symbols of each face are disposed to be read in an upside down manner with respect to each other. Each one of these game pieces therefore displays eight symbols in total (FIGS. 1A 1B and 2).

For example, four faces of the rectangular parallelepiped shape have each two symbols thereon, the two symbols on a same face are disposed to be read in an upside down manner with respect to one another.

For example, four faces of the rectangular parallelepiped shape have each two symbols thereon, the two symbols on a same face are disposed to be read in an upside down manner with respect to one another.

Figure 3:
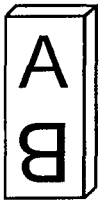
FIG. 3 is a perspective view of a game piece of a rectangular parallelepiped shape with two faces bearing two symbols on each face (not shown for the rear face) according to another example of the present disclosure.
Figure 4:
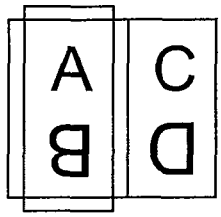
FIG. 4 is a schematic representation illustrating the six faces of the game piece of FIG. 3 in an open or unfolded configuration which displays four symbols according to another example of the present disclosure.

According to another embodiment, the game pieces can be of a rectangular parallelepiped shape with only two faces bearing two symbols each. These game pieces can be of a small thickness and only offer two main faces for displaying the symbols. The two symbols of each face can be disposed to be read in an upside down manner with respect to each other. Each one of these game pieces can therefore display four symbols in total (FIGS. 3 and 4).

Figure 6:
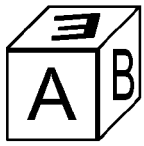
FIG. 6 is a perspective view of a game piece of a cubic shape with six rectangular faces bearing one symbol on each face according to another example of the present disclosure.
Figure 7:
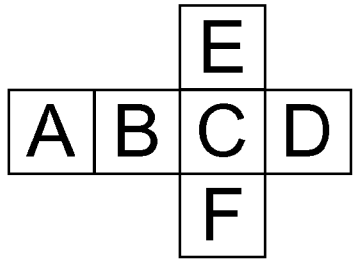
FIG. 7 is a schematic representation illustrating the six faces of the game piece of FIG. 6 in an open or unfolded configuration which displays six symbols according to another example of the present disclosure.

According to another embodiment, the game pieces can be of a cubic shape and each face of these game pieces has a symbol thereon. Each one of these game pieces can therefore display six symbols in total (FIGS. 6 and 7).

For example, the game pieces can have two faces displaying two symbols each.

For example, the game pieces can have four faces displaying two symbols each.

For example, the game pieces can have six faces, four of these faces displaying two symbols each.

For example, the game pieces can have six faces displaying one symbol each.

For example, the game pieces can have six faces displaying two symbols each.

For example, the game pieces can have six faces, two of these faces displaying two symbols each.

For example, the symbols displayed on the game pieces can be words, letters, numbers, punctuation symbols, blank spaces or mixtures thereof.

For example, the letters can be of Middle Eastern scripts, European alphabets or Asian alphabets.

The Holder

For example, in the kit of the present disclosure, the holder can comprise at least one holding section for holding the game pieces.

For example, in the holder 10, the at least one holding section 12 can comprise a front wall 14, a rear wall 16 and a bottom wall 18. Optionally, the at least one holding section can also comprise two sidewalls 20. The holder 10 also has a bottom end 22.

For example, the bottom wall of the at least one holding section can be grooved.

For example, in the kit of the present disclosure, the holder can comprise a plurality of holding sections for holding the game pieces. For example, the holding sections can be disposed one above the other. The bottom wall of each one of the holding sections can be at a different height with respect to the bottom of the holder. In fact, the distance between the bottom wall of the holding section and the bottom of the holder is different for each holding section.

Figure 5A:
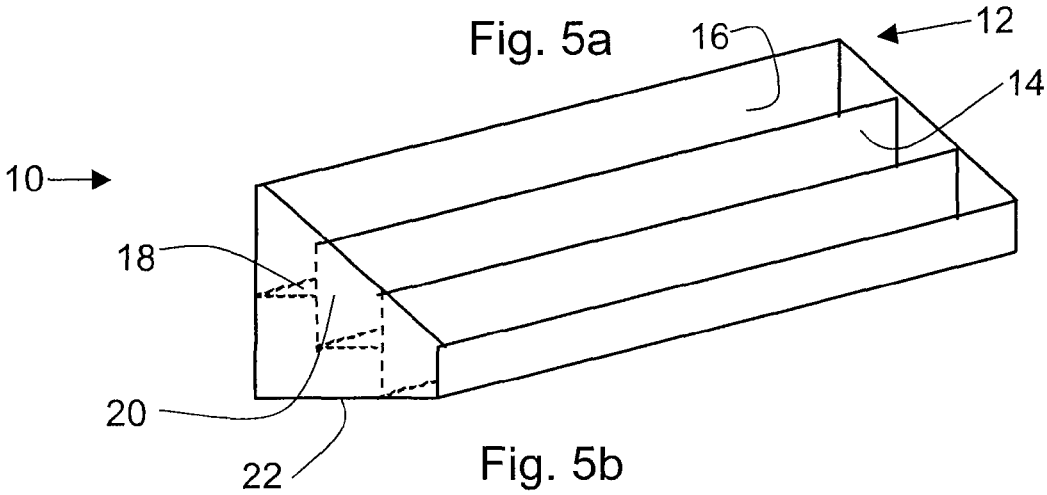
FIGS. 5*a* and 5*b* are perspectives views of a holder according to another example of the present disclosure, game pieces have been inserted in the holder in FIG. 5*b* for illustration purposes.
Figure 5B:
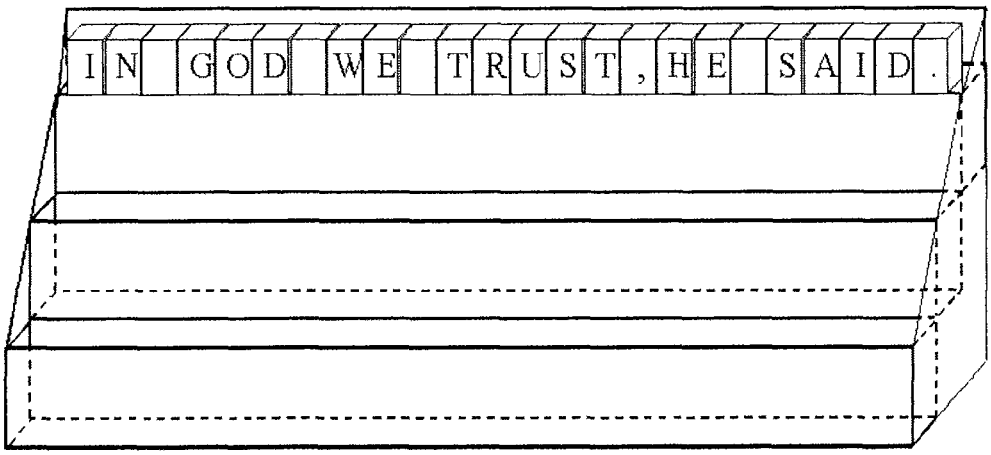

In one embodiment, the holding sections can be offset with respect to one another (step or stair configuration) (see FIGS. 5*a* and 5*b*).

Figure 8A:
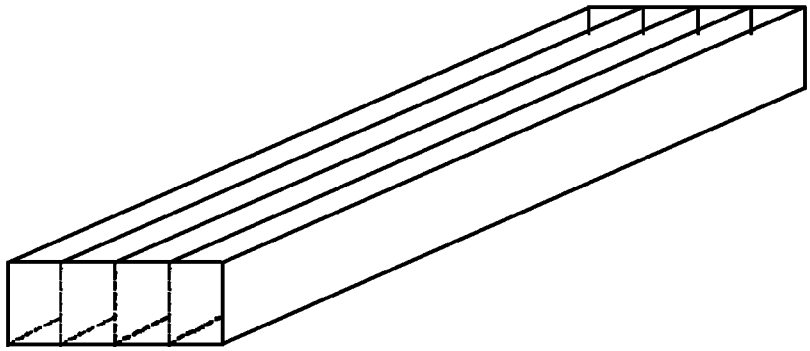
FIGS. 8*a* and 8*b* are perspectives views of a holder according to another example of the present disclosure, game pieces have been inserted in the holder in FIG. 8*b* for illustration purposes.
Figure 8B:
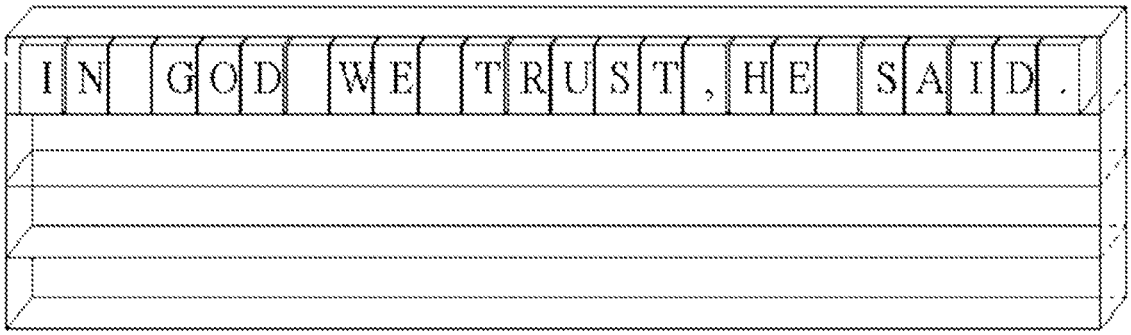

In another embodiment, the holding sections can be one above the other (see FIGS. 8*a* and 8*b*).

These arrangements allow the game pieces selected symbols to be well displayed.

For example, in the kit of the present disclosure, each holding section can allow for hiding all the symbols of the game pieces except one selected symbol for each game piece.

For example, in the kit of the present disclosure, each holding section can allow for hiding all the symbols of the game pieces except one symbol for each game piece, optionally with the exception of the game pieces that are disposed at the extremities of each holding section.

For example, regarding the holder of FIGS. 5*a* and 5*b*, the holding sections can be deep enough to cover the bottom half of a game piece face. Indeed, in order to display one symbol, the game piece can be inserted in the holder with the chosen symbol being on the top portion of the front face of the game piece (front-top portion of the game piece). When inserting the game piece in this position, all the symbols of the game pieces can be hidden except the selected symbol for each game piece. When inserted in the holder section, the symbols of a game piece can be hidden by the front wall (symbols present on front-bottom portion of the game piece), the rear wall (symbols present on rear-bottom and rear-top portions of the game piece, the adjacent game pieces or adjacent sidewalls (symbols on side-bottom and side-top portions of the game pieces).

For example, regarding the holder of FIGS. 8*a* and 8*b*, the holding sections can display only one symbol of a game piece having a cubic shape. Indeed, when inserted next to other game pieces in the holder, only one face of the game pieces can be displayed, which therefore allows the player to only show the symbol he/she has selected.

The holding sections can have a stop or sidewall at each extremity to prevent game pieces from falling off.

The combination of the game pieces and the holder, when the game pieces are inserted in the at least one holding section, can allow for hiding all the symbols of the game pieces except one symbol for each game piece.

The combination of the game pieces and the holder, when the game pieces are inserted in the at least one holding section can allow for hiding all the symbols of the game pieces except one symbol for each game piece, optionally with the exception of game pieces disposed at extremities of the holding section.

Rules

This game can be intended for at least two players. This game can be played using a game kit as those described in the present disclosure.

For example, the game kit can comprise instructions for using the game.

Beginning of the Game

For example, one of the players can be selected to start the game and each one of the other players can be given a turn to play.

For example, in order to complete the first step of the game, each player can pick up his/her game pieces. Each player can randomly pick up an even number of game pieces. For example, each player can pick up ten game pieces.

Game

For example, the second step of the game can consist in the creation of a word, sentence, expression, or small text together by all the players using the game pieces they have picked up.

In one embodiment, a first player can lay out a first word, sentence, expression, small text or beginning thereof onto a holding section of the holder using his/her game pieces and all other players can try to complete it turn by turn. Each player can place the game pieces that he/she has in his possession onto the holding section in a manner that only the symbol they have selected is showing. Indeed, since the holding sections of the holder can hide all but one of the symbols of the game pieces, each player can choose which one of the game pieces' symbols they which to use in completing the word, sentence, expression, or small text that was created by the previous players by placing it accordingly onto the holding section. Each game piece that a player uses in starting or completing the word, sentence, expression, or small text can grant him/her a point.

For example, before any point can be granted to a player for the game pieces he was able to place onto the holding section in starting or completing a word, sentence, expression, or small text, all other players can be asked the verify the validity of what has been added by the player. In one embodiment, if a player makes a grammatical, syntax or semantic error, no points can be allowed to him/her and he has to take back the game pieces he/she had placed onto the holding section. He/she therefore can loose his/her turn.

In one embodiment, a player can pass his/her turn if he/she is of the opinion that he/she cannot add anything to the word, sentence, expression, or small text that is onto the holder. This player can therefore pick up a certain amount of game pieces that he/she will be able to use at his/her next turn. It is to be noted however that a player can have a maximum of twelve game pieces.

In one embodiment, if a question arises regarding a grammatical, syntax or semantic issue, a dictionary or any other official reference document can be consulted.

The present disclosure has been described with regard to specific examples. The description was intended to help the understanding of the disclosure, rather than to limit its scope. It will be apparent to one skilled in the art that various modifications may be made to the disclosure without departing from the scope of the disclosure as described herein, and such modifications are intended to be covered by the present document.

The invention claimed is:

1. A game kit comprising:

a plurality of game pieces having a parallelepiped shape in which four faces of said parallelepiped shape have each two symbols thereon, a first symbol on a first half of a face and a second symbol on a second half of said face, said two symbols on a same face being written in an upside down manner with respect to one another; and a holder comprising at least one holding section for holding said game pieces in such a manner that when at least one of said game pieces is inserted in said holding section, a combination of said game pieces and said holding section is effective for hiding all the symbols of the game pieces except one selected symbol on one selected half of one selected face for each game piece, optionally with the exception of game pieces disposed at extremities of said holding section.

2. The kit of claim 1, wherein said game pieces are chosen from pawns and counters.

3. The kit of claim 1, wherein said symbols comprise words.

4. The kit of claim 1, wherein said symbols are chosen from words, letters, numbers, punctuation symbols, blank spaces and mixtures thereof.

5. The kit of claim 1, wherein said symbols comprise letters, blank spaces and punctuation symbols.

6. The kit of claim 4, wherein said letters are chosen from European alphabets.

7. The kit of claim 1, wherein said game pieces have a rectangular parallelepiped shape and said four faces having each two symbols thereon are lateral faces.

8. The kit of claim 1, further comprising instructions for using said game.

9. The kit of claim 1, wherein said combination of said game pieces and said holder, when said game pieces are inserted in said at least one holding section, allows for hiding all the symbols of said game pieces except one symbol on one selected half of one selected face, for each game piece.

10. The kit according to claim 1, wherein said at least one holding section comprises a front wall, a rear wall, a bottom wall and optionally two sidewalls.

11. The kit according to claim 1, wherein said holder comprises a plurality of holding sections, each holding section being one above the other.

12. The kit according to claim 11, wherein said holder comprises a plurality of holding sections, each holding section being offset with respect to one another.

13. The kit according to claim 12, wherein a bottom wall of each one of said holding sections is at a different height with respect to a bottom end of said holder.

* * * * *